US010006617B2

(12) United States Patent
Pattekar et al.

(10) Patent No.: US 10,006,617 B2
(45) Date of Patent: Jun. 26, 2018

(54) LED BULB WITH INTEGRATED THERMAL AND OPTICAL DIFFUSER

(71) Applicant: Palo Alto Research Center Incorporated, Palo Alto, CA (US)

(72) Inventors: Ashish Pattekar, Cupertino, CA (US); Christopher Paulson, Livermore, CA (US); Ramkumar Abhishek, Menlo Park, CA (US); Patrick Yasuo Maeda, San Jose, CA (US)

(73) Assignee: Palo Alto Research Center Incorporated, Palo Alto, CA (US)

( * ) Notice: Subject to any disclaimer, the term of this patent is extended or adjusted under 35 U.S.C. 154(b) by 0 days. days.

(21) Appl. No.: 15/818,296

(22) Filed: Nov. 20, 2017

(65) Prior Publication Data

US 2018/0073713 A1 Mar. 15, 2018

Related U.S. Application Data

(60) Continuation of application No. 29/542,137, filed on Oct. 12, 2015, now Pat. No. Des. 806,308, which is a division of application No. 29/490,179, filed on May 7, 2014, now Pat. No. Des. 740,995, which is a (Continued)

(51) Int. Cl.

| | |
|---|---|
| ***F21V 29/00*** | (2015.01) |
| ***F21V 29/83*** | (2015.01) |
| ***F21K 9/232*** | (2016.01) |
| *F21Y 115/10* | (2016.01) |

(52) U.S. Cl.

CPC ..... *F21V 29/00* (2013.01); *F21K 9/232* (2016.08); *F21V 29/83* (2015.01); *F21Y 2115/10* (2016.08)

(58) Field of Classification Search

CPC ..... F21V 29/00; F21V 29/83; F21K 9/232

See application file for complete search history.

(56) References Cited

U.S. PATENT DOCUMENTS

| | | | |
|---|---|---|---|
| D154,730 | S | 8/1949 | Zabel |
| D158,033 | S | 4/1950 | Zabel |
| 2,987,640 | A | 6/1961 | Paolino |

(Continued)

FOREIGN PATENT DOCUMENTS

| | | |
|---|---|---|
| EP | 1453107 | 9/2004 |
| WO | WO2009/071111 | 6/2009 |

(Continued)

OTHER PUBLICATIONS

U.S. Appl. No. 29/490,179, Pattekar et al.

*Primary Examiner* — Evan Dzierzynski

(74) *Attorney, Agent, or Firm* — Hollingsworth Davis, LLC

(57) ABSTRACT

A light emitting diode (LED) light bulb includes a thermally conductive base and at least one LED assembly disposed on and thermally coupled to a surface of the base. The LED assembly includes at least one LED configured to generate light. A thermal optical diffuser defines an interior volume and the LED is arranged to emit light into the interior volume and through the thermal optical diffuser. The thermal optical diffuser is disposed on the surface of the base and extends from the base to a terminus on the light emitting side. The thermal optical diffuser is configured to include one or more openings that allow convective air flow between the interior volume of the thermal optical diffuser and ambient environment.

24 Claims, 15 Drawing Sheets

Related U.S. Application Data continuation of application No. 13/671,372, filed on Nov. 7, 2012, now Pat. No. 8,764,247.

(56) References Cited

U.S. PATENT DOCUMENTS

| | | | | |
|---|---|---|---|---|
| D240,956 | S | 8/1976 | Holmes | |
| 4,630,177 | A | 12/1986 | Von Kohorn et al. | |
| D306,118 | S | 2/1990 | Guerrero | |
| D368,670 | S | 4/1996 | Taylor | |
| D461,233 | S | 8/2002 | Whalen | |
| D469,565 | S | 1/2003 | Anderson et al. | |
| D558,549 | S | 1/2008 | Ozaki-Owen | |
| D613,885 | S | 4/2010 | Lodhie | |
| D623,338 | S | 9/2010 | Mo | |
| 7,874,710 | B2 * | 1/2011 | Tsai | F21V 29/004 362/294 |
| D650,097 | S | 12/2011 | Trumble et al. | |
| D683,867 | S | 6/2013 | Rioux et al. | |
| D690,053 | S | 9/2013 | Zhang et al. | |
| D698,982 | S | 2/2014 | Scatena | |
| D702,326 | S | 4/2014 | Dannrup | |
| D703,482 | S | 4/2014 | D'Amore et al. | |
| 8,764,247 | B2 | 7/2014 | Pattekar et al. | |
| D720,876 | S | 1/2015 | Haverfield | |
| D740,995 | S | 10/2015 | Pattekar et al. | |
| D792,016 | S | 7/2017 | de Bevilacqua et al. | |
| 2007/0159828 | A1 | 7/2007 | Wang | |
| 2009/0103293 | A1 | 4/2009 | Harbers et al. | |
| 2009/0290343 | A1 | 11/2009 | Brown et al. | |
| 2010/0165632 | A1 | 7/2010 | Liang | |
| 2010/0314985 | A1 | 12/2010 | Premysler | |
| 2011/0080096 | A1 | 4/2011 | Dudik et al. | |
| 2011/0115358 | A1 | 5/2011 | Kim | |
| 2011/0156584 | A1 | 6/2011 | Kim | |
| 2011/0267801 | A1 | 11/2011 | Tong et al. | |
| 2012/0044642 | A1 | 2/2012 | Rodriguez | |
| 2012/0057327 | A1 | 3/2012 | Le et al. | |
| 2012/0080699 | A1 | 4/2012 | Chowdhury et al. | |
| 2012/0182736 | A1 | 7/2012 | Lee et al. | |
| 2012/0188767 | A1 | 7/2012 | Igaki et al. | |
| 2012/0230036 | A1 | 9/2012 | Yu | |
| 2013/0135858 | A1 * | 5/2013 | Wu | F21V 29/20 362/235 |
| 2013/0335978 | A1 * | 12/2013 | Huang | F21V 17/16 362/311.02 |

FOREIGN PATENT DOCUMENTS

| | | |
|---|---|---|
| WO | WO2011109092 | 9/2011 |
| WO | WO2011109098 | 9/2011 |

* cited by examiner

LED BULB WITH INTEGRATED THERMAL AND OPTICAL DIFFUSER

RELATED APPLICATIONS

This application is a continuation of U.S. Ser. No. 29/542,137, filed Oct. 12, 2015, which is a divisional of U.S. Ser. No. 29/490,179, filed May 7, 2014, now U.S. Design No. D740995, which is a continuation of U.S. Ser. No. 13/671,372, filed Nov. 7, 2012, now U.S. Pat. No. 8,764,247, which are incorporated herein by reference in their entireties.

TECHNICAL FIELD

This application relates generally to light emitting diode (LED) light bulbs. The application also relates to components, devices, and systems pertaining to such LED light bulbs.

SUMMARY

Some embodiments disclosed herein involve a light emitting diode (LED) light bulb that includes a thermally conductive base and at least one LED assembly disposed on and thermally coupled to a surface of the base. The LED assembly includes at least one LED configured to generate light. A thermal optical diffuser defines an interior volume and the at least one LED is arranged to emit light into the interior volume and through the thermal optical diffuser. The thermal optical diffuser is disposed on the surface of the base and extends from the base to a terminus on the light emitting side. The thermal optical diffuser is configured to include one or more openings that allow convective air flow between the interior volume of the thermal optical diffuser and ambient environment.

Some embodiments disclosed herein involve an LED light bulb that includes a thermally conductive base and at least one LED assembly disposed on and thermally coupled to a surface of the base. The LED assembly comprises at least one LED configured to generate light. The LED light bulb includes a thermal optical diffuser that defines an interior volume wherein the at least one LED is configured to emit light into the interior volume and through the thermal optical diffuser. The thermal optical diffuser is disposed on the same surface of the base as the LED assembly and extends from the surface of the base to a terminus. The thermal optical diffuser comprises a material having a thermal conductivity greater than about 100 W/(mK).

Yet another embodiment involves an LED light bulb comprising a thermally conductive base and at least one LED assembly disposed on and thermally coupled to a surface of the base. A thermal optical diffuser is coupled to the surface of the base and defines an interior volume. The LED assembly includes at least one LED arranged to emit light into the interior volume and through the thermal optical diffuser. The thermal optical diffuser comprises optical features having an irregular arrangement and a material that has a thermal conductivity greater than about 100 W/(mK).

The above summary is not intended to describe each embodiment or every implementation. A more complete understanding will become apparent and appreciated by referring to the following detailed description and claims in conjunction with the accompanying drawings.

BRIEF DESCRIPTION OF THE DRAWINGS

Like reference numbers refer to like components; and

Figure 1:
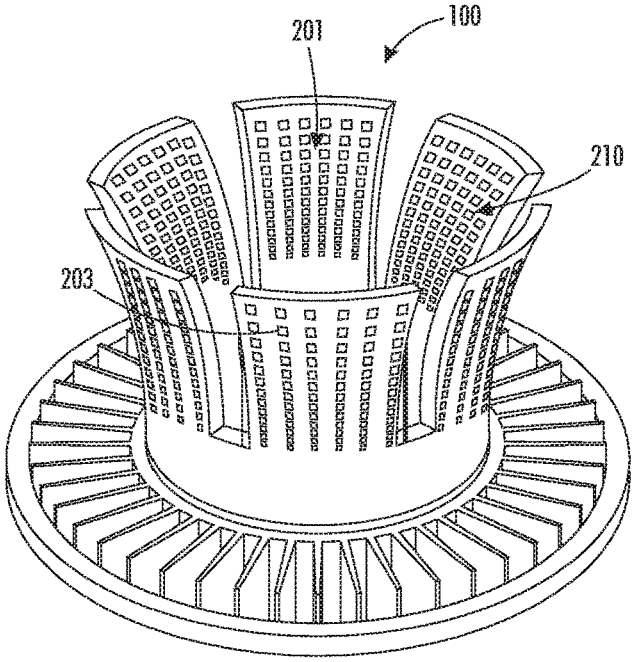
FIGS. 1 and 2 are perspective and cross section views, respectively, of one configuration of portion of an LED light bulb that includes a thermal optical diffuser (TOD) according to embodiments discussed herein.

Drawings are not necessarily to scale unless otherwise indicated.

DESCRIPTION OF VARIOUS EMBODIMENTS

Light emitting diode (LED) light bulbs can substantially increase residential and commercial energy efficiency if they achieve sufficient market adoption. However, commercially available designs are presently limited to 60 Watt-equivalent (We) luminosity. Market adoption is hindered by the lack of LED bulbs capable of replacing the common 75 W and 100 W incandescent bulbs to consumer satisfaction. Thermal management is a primary technology barrier to achieving higher luminosity in current LED bulb designs. State of the art approaches rely on heat sinks that remove heat only from the backside of the LED bulbs, so as not to interfere with the light output path on the front side. This constrains the heat rejection area to the region behind the LED, leading to high temperatures, lower efficiency, and shortened life.

A limiting factor in the widespread adoption of LED light bulbs has been the lack of units capable of replacing the most common 75 W and 100 W incandescent light bulbs. LED bulb designs in the incandescent replacement market today are limited to a maximum of 60 Watt-equivalent (We) operation, covering only the lower end of the potentially large retrofit market.

Thermal management is a primary technology barrier to achieving higher luminosity in LEDs. Maintaining the incandescent form factor supports mass adoption without requiring entirely new luminaires, and this forces the entire light source (including the driver electronics, LED chip(s), light diffuser, and heat sink) to be tightly packed into a small form factor. This small form factor leads to a challenging thermal management problem.

In a typical 11 to 12 W (electric) LED bulb with 60 We luminosity, about 15% (~2 W) of the total electricity is wasted as heat in the driver electronics, and of the remaining 85% (~10 W), at least half (~5 to 6 W) is dissipated as heat in the LED chip itself. Inefficient rejection of all this heat through the limited surface area available on the backside of the bulb leads to overheating at operating levels beyond the 60 We available today.

In contrast to traditional approaches that rely on removal of substantial amount of the heat only from the backside of the LED bulb, embodiments discussed herein involve approaches for thermal an optical management of LED light bulbs that enable removal of a significant amount of heat from the light emitting side as well, without compromising light transmission. The solution utilizes an integrated thermal and optical diffuser in the form of an engineered element that provides a large surface area for heat dissipation to ambient air while efficiently reflecting and/or transmitting light out of the structure. In some implementations, the integrated thermal optical diffuser can include a number of openings that support convective airflow from the ambient environment into the interior of the thermal optical diffuser. In some configurations, the air flow path is arranged so that ambient air enters the interior volume of the thermal optical diffuser and air flows over a light emitting surface of the LED. The approaches described herein have the potential to enable practical LED bulbs at 100 We and beyond, providing coverage of the incandescent market, increasing LED adoption, and decreasing near term electrical demand.

The integrated thermal and optical diffuser disclosed herein uses an engineered element that enhances heat dissipation surface area and air flow within an interior volume of the light bulb and uses highly heat conductive and optically reflective/transmissive materials to enhance heat dissipation while maintaining or improving the controlled diffusion of light. For example, the thermal resistance of the integrated thermal and optical diffuser can be less than about 4° C./W and the integrated thermal and optical diffuser may use materials having an optical reflectivity of visible light greater than about 70% and/or an optical transmittance of visible light greater than about 50%.

Figure 2:
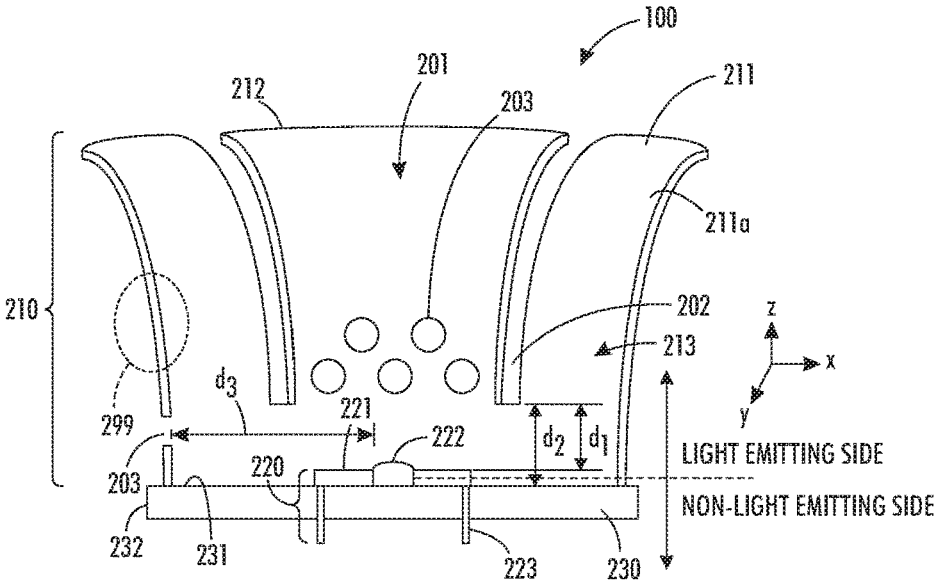

FIGS. 1 and 2 are perspective and cross section views, respectively, of one configuration of portion of an LED light bulb 100 that includes a thermal optical diffuser (referred to herein as TOD) 210 oriented within a Cartesian coordinate system as indicated by mutually orthogonal axes, x, y, and z. The light bulb 100 includes a thermally conductive base 230 and at least one LED assembly 220 including one or more LEDs 222 assembled in packaging 221, e.g., hermetically sealed packaging that provides some environmental protection for the LEDs 222 and provides support for the LEDs 222 to facilitate handling. The LED assembly 220 includes electrical contacts 223 that are useful for electrically coupling the LEDs 222 to driver electronics (not shown in FIG. 1 or 2) which is located within the LED light bulb 100, typically within the non-light emitting side of the bulb. The LED assembly 220 is disposed on the surface 231 of the base 230 and is thermally coupled to the base 230.

The base 230 may comprise a thermally conductive material, such as a metal or a metal alloy, with copper or aluminum in pure or alloyed form being representative materials that can be used for the base 230. The base 230 may have any shape, including circular, elliptical, rectangular, etc., and may have proportions that allow it to be arranged within typical incandescent light bulb form factors such as type A, B, BR/R, BT, G, MR, PAR, R/K, or T, etc. The base 230 has a surface area and thickness sufficient to provide heat sinking for the LED assembly 220. For example, in various configurations, the base 230 may have dimensions of about 10 to 15 $cm^2$ surface area and thickness of about 1 to 4 cm.

The light bulb 100 includes a TOD 210. The TOD is attached permanently, e.g., by welding braising, soldering, riveting to the base or may be attached to the base using removable fasteners, such as screws. In some implementations, the base 230 and the TOD 210 may be a one-piece unit. As illustrated in FIGS. 1 and 2, the TOD 210 may be attached to the same surface 231 of the base 230 as the LED assembly 220. The TOD 210 may also be attached to other surfaces of the base 230 such as one or more sides 232 of the base 230. The TOD 210 may comprise one or more structural elements 211 that extend, individually or in combination, from the base 230 to a terminus 212 which is the farthest point of the TOD 210 from the base 230 along the z axis.

In the illustrated example of FIGS. 1 and 2, the structural elements 211 of the TOD 210 resemble petals which extend (along the z direction in FIG. 2) and expand outward (along the x and y directions in FIG. 2) from the base 230. The structural elements 211 define an interior volume 213 within the TOD 210. The interior volume 213 extends from the base 230 to the terminus 212, and between the inner surfaces 211*a* of the structural elements 211. Structural geometry of the TOD may be selected such that the TOD provides a surface area in contact with ambient air of at least 4 $cm^2$ for every 1 $cm^3$ of volume of the TOD. The structural geometry of the TOD enhances total light output of the LED assembly and enables overall bulb dimensions similar to an incandescent bulb of equivalent luminosity.

The LED assembly 220 is disposed within the interior volume 213 and is oriented so that the one or more LEDs 222 emit visible light into the interior volume 213 and through a portion of the interior volume to the ambient environment outside the TOD 210. The term "light" as used herein is used to refer to visible light, typically comprising of electromagnetic radiation of wavelengths in the range of 390 nanometers to 750 nanometers. The light bulb 100 shown in FIGS. 1 and 2 can be thought of as having a light emitting (front) side and a non-light emitting (back) side, with the TOD arranged primarily on the light emitting side. In some cases, the light projected into the interior volume 213 may exit the TOD 210 through openings 201-203 in the TOD 210. For example, the openings 201-203 may be arranged between (e.g., gaps 202) or through (e.g., holes 203) structural members 211. For example, FIG. 2 illustrates gaps 202 between the structural members 211, holes 203 through the structural members 211 and a large opening 201 near the terminus 212 of the TOD 210. In some implementations, as discussed below, the openings 201-203 may be arranged between the TOD 210 and the base 230. In other implementations, there may be no dominant (large) opening such as 201; this would be the case where the TOD consists solely of a structural element with a selected distribution of a number of small openings such as 202 and 203 arranged at various locations on and within the TOD including at and near the terminus plane.

If openings are present in the TOD 210, the openings may be arranged so that convective airflow occurs between ambient environment and the interior volume 213 of the TOD 210. In this regard, the convective airflow brings cooler, ambient air into the interior volume 213 and allows exit of air within the interior volume 213 that has been heated by the LEDs 222. The TOD 210 can be designed so that the flow path of air from the ambient environment flows over the base 230, or flows over the LED assembly 220, including over the light emitting surface of the LED 222. The TOD geometry may be selected so as to have a large surface area of the TOD in contact with the freely flowing ambient air, so as to maximize the amount of heat removed from the bulb to the ambient environment.

As shown in FIG. 2, openings 202, 203 can be arranged in relation to the LED assembly 220 and/or the surface 231 of the base 230 so that the distance in the z direction between the LED assembly 220 and closest opening 202, 203 is $d_1$, the distance in the z direction between the surface 231 of the base 230 and closest opening 202, 203 is $d_2$; and the distance in the xy plane between the closest opening 202, 203 and the LED assembly 220 is $d_3$. For example, the LED assembly 220, base 230, and TOD 210 may be arranged so that $d_1$ is less than about 8 mm, $d_2$ is less than about 10 mm, and/or $d_3$ is less than about 20 mm In contrast to traditional LED bulb designs that rely on a heat sink located on the backside (non-light emitting side) of the bulb alone, the integrated thermal optical diffuser approach described herein enables substantial heat removal from the front (light-emitting) side of the bulb, in addition to the traditional back-side heat removal. In fact, conventional LED bulb designs typically utilize a front-side light (optical) diffuser in the form of a glass or plastic shell that encloses the LEDs and provides the desired output light distribution, but substantially impedes air flow on the front side and does not serve any thermal management function.

Removal of heat from the light emitting side becomes especially important in applications wherein the air flow and (therefore the ultimate heat transfer rate) on the backside of the bulb may be severely limited. For example, the backside heat sink of the typical LED bulb is frequently located inside a luminaire enclosure and therefore exposed to impeded air flow/stagnant air (e.g., in fixtures such as those used for recessed lighting.) Moreover, in the case of ceiling recessed lighting, the backside of the bulb may be exposed to the hot environment inside the attic—further reducing the heat removal rate from a bulb utilizing only a backside heat sink.

By utilizing the freely flowing air on the light emitting side of the bulb, and effectively coupling the heat generated in the bulb to the freely flowing ambient air on the front-side with the integrated optical and thermal diffuser, the designs discussed herein provide lower overall operating temperatures and longer device lifetime as will be discussed in the examples below.

Figure 3:
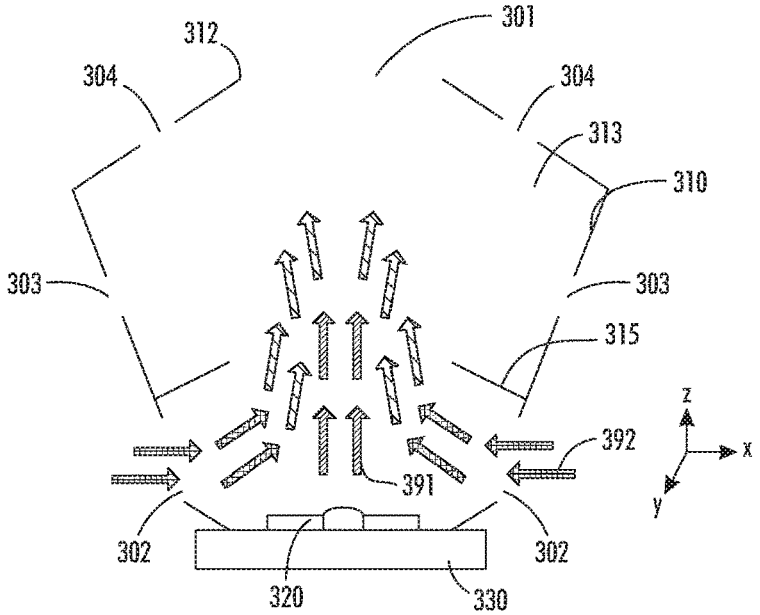
FIG. 3 diagrammatically illustrates convective airflow through the TOD when the light bulb is oriented so that the TOD extends from the base to the terminus in the positive z direction referred to as the "bulb up" orientation.
Figure 4:
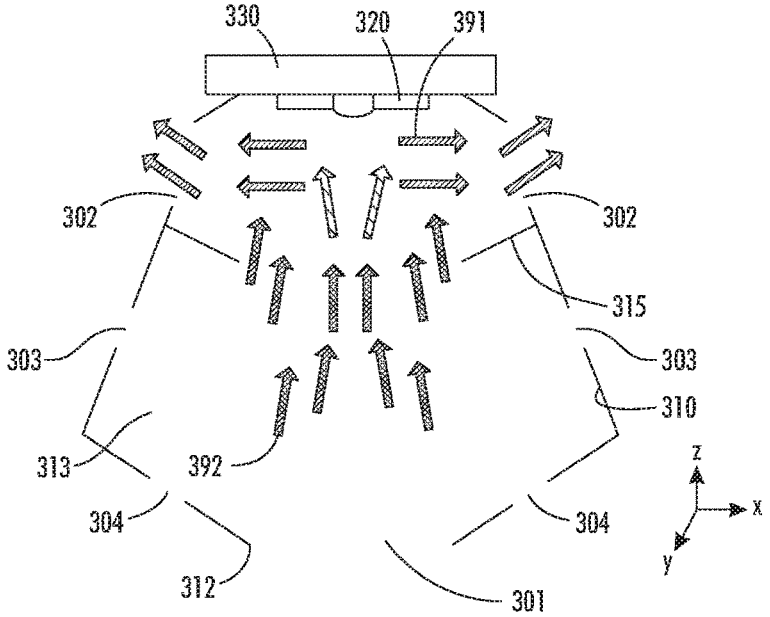
FIG. 4 diagrammatically illustrates convective airflow through the TOD when the light bulb is oriented so that the TOD extends from the base to the terminus in the negative z direction referred to as the "bulb down" orientation.

FIG. 3 diagrammatically illustrates convective airflow through the TOD when the light bulb is oriented so that the TOD 310 extends from the base 330 to the terminus 312 in the positive z direction referred to as the "bulb up" orientation. FIG. 4 diagrammatically illustrates convective airflow through the TOD when the light bulb is oriented so that the TOD 310 extends from the base 330 to the terminus 312 in the negative z direction, referred to as the "bulb down" orientation. In FIG. 3, when the LED light bulb is in the "bulb up" orientation, air 391 heated by the LED assembly 320 and the base 330 rises through the interior volume 313 of the TOD 310 towards openings 301, 304. TOD 310 may further include geometrical features and/or interior elements (e.g., shells with openings, spikes etc.) that provide enhanced surface area for heat exchange with air 391 as it rises through the interior of TOD 310. Cooler ambient air 392 is drawn in through openings 302, 303, and flows in proximity to the surface of the base 330 and/or LED assembly 320, providing additional cooling for the base 330 and the LED assembly 320, in addition to removing the heat conducted away from the base 330 by the TOD 310 itself.

As illustrated in FIG. 4, when the light bulb is oriented in the "bulb down" orientation, air 391 heated by the LED assembly 320 and/or the base 330 flows through nearby holes 302 and exits the interior volume 313. The exit of warmer air through holes 302 draws in cooler ambient through openings 301, 303, 304 in TOD 310. The cooler air flows over the base 330 and/or LED assembly 320, providing air cooling for these components 330, 320, in addition to removing the heat conducted away from the base 330 by the TOD 310 itself. In some configurations, the TOD 310 may include one or more baffles 315 that protrude into the interior volume 313 and that serve to direct the convective airflow to enhance the overall heat transfer rate and also provide increased surface area in the interior of the TOD in contact with the air. In some cases, the baffles may be capable of moving from a first position (for a light bulb up orientation) to a second position (for a light bulb down orientation). The first position of the baffles may be designed to provide optimal convective airflow when the light bulb is in the light bulb up orientation and the second position of the baffles may be designed to provide optimal convective airflow when the light bulb is in the light bulb down orientation.

Figure 5:
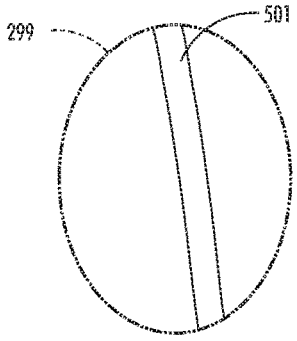
FIGS. 5-7 show various configurations for structural elements of the TOD.

Referring back to FIG. 2, circle 299 indicates a cross sectional portion of a structural element 211 of the TOD 210. The TOD may be formed according to various configurations, some of which are illustrated in the inset drawings 299 of FIGS. 5-7. For example, in some implementations, as illustrated by FIG. 5, the TOD may be formed of a material 501 (e.g., a single homogenous material or in some cases, a homogenous mixture of materials), having properties of both suitable thermal conductivity (e.g., thermal conductivity greater than about 100 W/mK or even greater than about 150 W/mK) and which can provide the specified optical diffusion for the TOD. Materials used for a TOD of this construction include metals, metallic alloys, sintered metals, thermally conductive ceramic, thermally conductive polymer, mica, diamond, and/or other materials that can provide desired heat sinking/transfer capacity and light diffusion. The material used for the TOD may be optically opaque or optically transmissive, e.g., having optical transmittance greater than about 50% or even greater than 75% for visible light, and/or the material used for the TOD may be optically reflective, e.g. having reflectivity greater than about 70% for visible light. Suitable optically transmissive materials include diamond, mica, and/or transparent metals or metal oxides, such as indium tin oxide (ITO). Suitable optically reflective materials can include ceramics, plastics, polymers, and metals, for example. The reflectivity of a material depends on the surface finish of the material.

The TOD may be formed by casting, stamping, molding, machining, cutting, 3-D printing, selective laser sintering (SLS), or any other suitable fabrication process. The TOD may be a single cast, stamped, molded, machined, etc., component, or may be component assembled from cast, stamped, molded, machined, etc., piece parts. All or a portion of the interior and/or exterior surfaces of the TOD may be surface treated to achieve specified optical characteristics. For example, all or a portion of the surfaces of the TOD may be surface treated, such as by polishing or roughening.

Diffusion of light in the TOD can be achieved by reflection of light from surfaces of the TOD and/or by optical scattering during transmission of light through a structural element of the TOD. In some cases, overall diffusion of light from the TOD can occur when light from the LEDs is specularly reflected from multiple surfaces or facets of the TOD. Specular reflection occurs at smooth, shiny surfaces, such as polished metal, whereas diffuse reflection occurs at rough surfaces. In some cases, light transmission through a structural element of the TOD may cause a portion of the light striking the surface of the structural element to be diffusively transmitted and a portion of the light striking the surface to be diffusively reflected. The materials selected for the TOD may provide specular reflection, diffuse reflection, and/or transmissive diffusion of light while also providing suitable heat sinking capacity for the LED as discussed above. In the case of reflective surfaces of the TOD, these surfaces may have at least 70% reflectivity as previously discussed.

Figure 6:
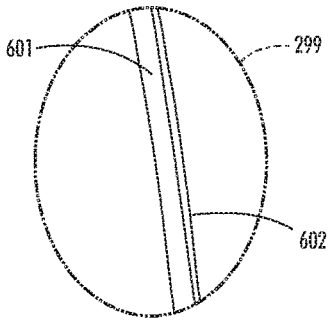

In some configurations, illustrated by cross section shown in FIG. 6, the TOD may comprise a layered structure. One or more of the structural elements of the TOD may comprise a number of layers 601, 602 that contribute to the thermal and optical diffusion capabilities of the TOD, either individually or in combination with each-other. In some configurations, a first layer 601, e.g., oriented away from the interior volume (213 in FIG. 2) of the TOD, may comprise a material that provides suitable thermal conductivity for the TOD. A second layer 602, which in some cases may be thinner than layer 601, may comprise a different material or the same material as the first layer 601, differently treated, that provides for diffusion or reflection of light. The second layer 602, may comprise a roughened surface, a microstructured surface, an embossed surface, a coated surface, e.g., phosphor coated surface, a specularly or diffusively reflective surface, for example. In some cases, both layers 601, 602 may transmit light, and in some cases, both layers may be opaque.

Figure 7:
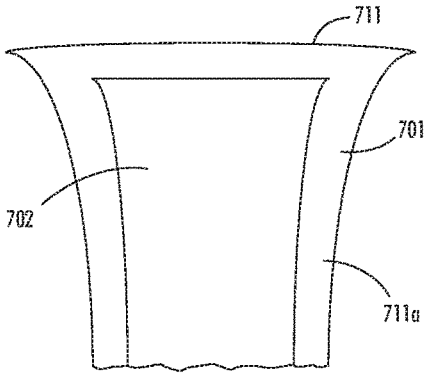

FIG. 7 shows an inner surface 711*a* of structural element 711 of a TOD. The inner surface 711*a* is oriented facing the TOD's interior volume. In the arrangement of FIG. 7, the TOD structural element 711 comprises multiple regions of different materials 701, 702 Although two regions are shown in FIG. 7, more than two regions are possible. One of the regions may be optically transmissive or reflective, while another of the regions is opaque or non-reflective. For example, one of the regions may be opaque and may provide the TOD with suitable thermal conductivity, whereas another of the regions may have relatively high thermal conductivity, but may provide characteristics of reflectivity or light transmission that provides for optical diffusion of the TOD.

Figure 8:
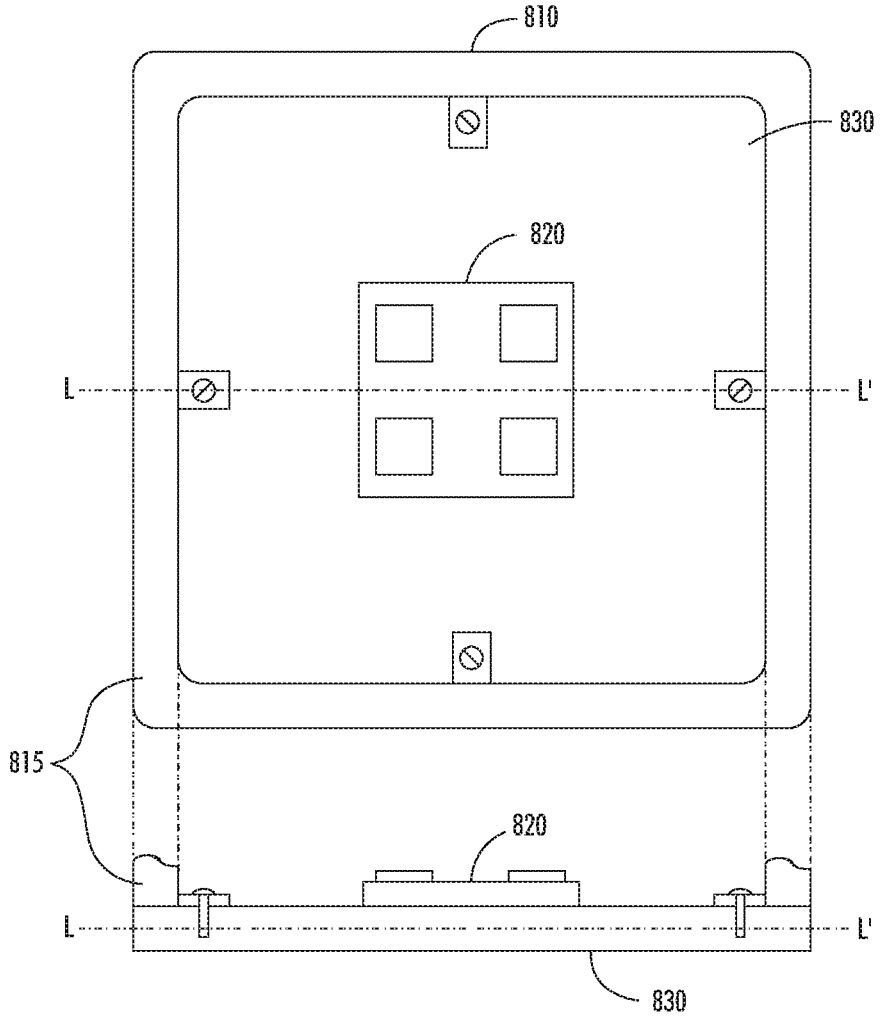
FIGS. 8-10 show configurations for mechanical and thermal connection of the TOD and the base.
Figure 9:
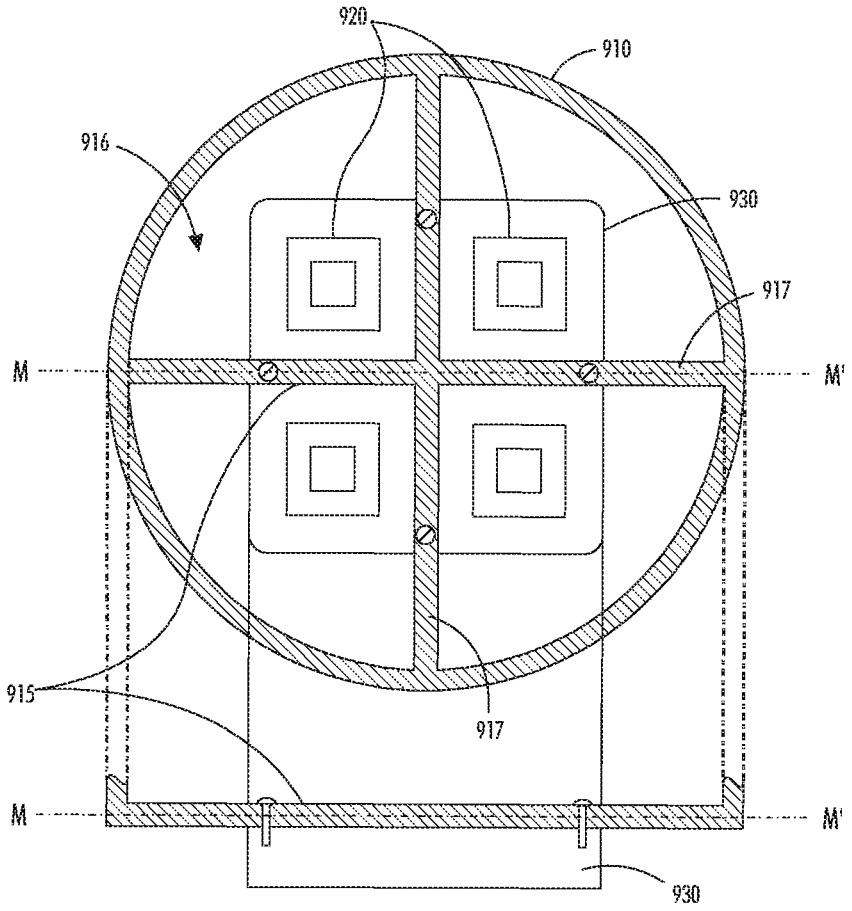
Figure 10:
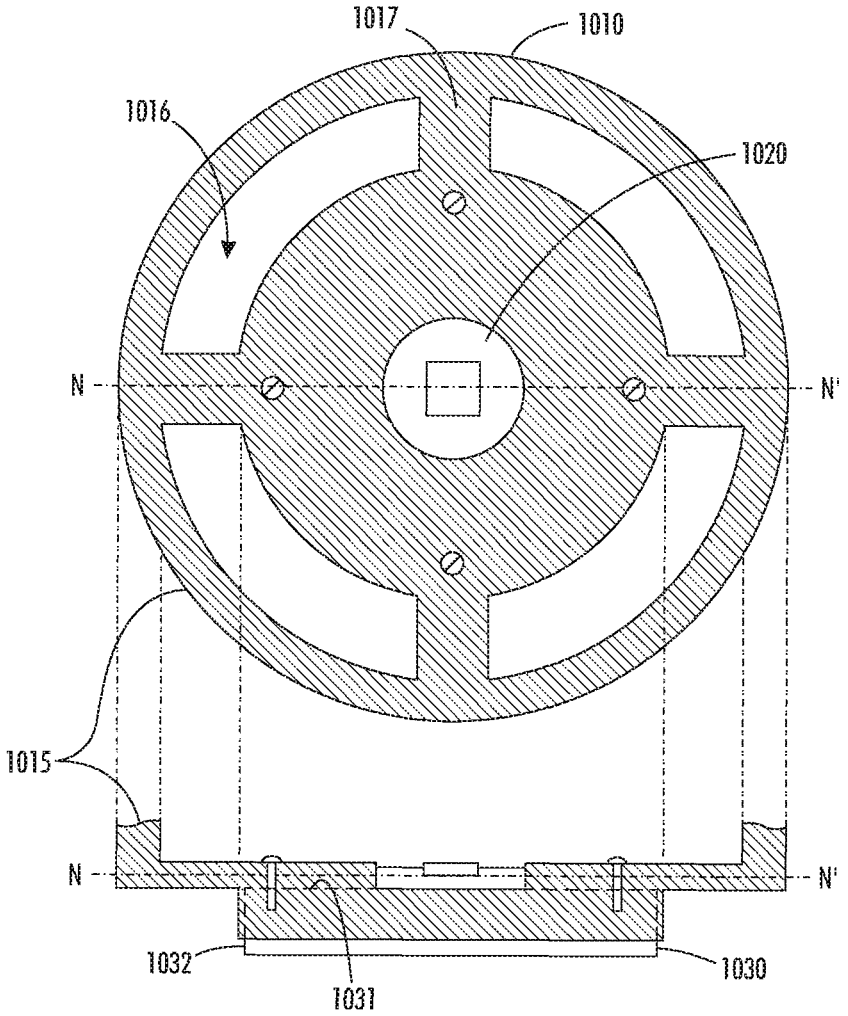

FIGS. 8-10 show a few of many configurations for mechanical and thermal connection of the TOD and the base. As illustrated in FIGS. 8-10, the TOD 810, 910, 1010 includes a mounting portion 815, 915, 1015 that is mechanically and thermally coupled to the base 830, 930, 1030. In each illustrated example, the mounting portion 815, 915, 1015 is disposed on the same surface 831, 931, 1031 of the base 830, 930, 1030 as the LED assembly 820, 920, 1020. In the example shown in FIG. 10, the mounting portion 1015 of the TOD 1010 is disposed on the surface 1031 of the base 1030 and extends along the sides 1032 of the base 1030.

In FIGS. 9 and 10, the mounting portion 915, 1015 of the TOD 910, 1010 extends beyond the base surface 931, 1031 in the xy plane, although this need not be the case, as illustrated in FIG. 8. As shown in FIGS. 9 and 10, if the mounting portion of the TOD 915, 1015 is larger in the xy plane than the base 930, 1030 at the base surface 931, 1031, openings 916, 1016 may be located between the TOD 910, 1010 and base 930, 1030 which facilitates air flow into or out of the interior volume of the TOD 910 1010.

FIG. 8 shows a plan view of a mounting portion 815 of an exemplary TOD 810 along with a cross section view taken along line L-L'. In this example, the mounting portion 815 of the TOD 810 and the mounting surface 831 of the base 830 are commensurate in size and the mounting portion 815 of the TOD 810 does not extend substantially beyond the base surface 831 in the xy plane. The mounting portion 815 of the TOD 830 completely encircles the LED assembly 820. In some configurations, the mounting portion 815 may partially encircle the LED assembly 820. In some configurations, multiple LED assemblies may be used where the TOD mounting portion encircles or partially encircles multiple LED assemblies mounted on the base surface. For example, in some cases, it can be helpful for heat dissipation if the LED assemblies are arranged at locations near, e.g., within a few millimeters of, the mounting portion of the TOD.

The base 830 and the TOD mounting portion 815 are both made of thermally conductive materials (the base and the TOD mounting portion can be made of the same thermally conductive material). The mounting portion 815 has sufficient surface area in contact with the base 830 to provide a thermal resistance between the base 830 and the mounting portion 815 of the TOD 810 of less than about 0.5° C./W. The base may be attached to the mounting portion by any suitable means, including welding, brazing, soldering, riveting, etc. The base may be attached to the mounting portion using thermal adhesive, removable screws (depicted in FIG. 8) detachable clamps and/or other means.

FIG. 9 shows a plan view of a mounting portion 915 of an exemplary TOD 910 along with a cross section view taken along line M-M'. The configuration illustrated in FIG. 9 shows multiple LED assemblies 920 mounted on the surface 931 of the base 930. In this configuration, the mounting portion 915 of the TOD 910 includes cross bars 917 that are disposed on the base surface 931 between the LED assemblies 920. This cross bar arrangement may be used to help dissipate heat when multiple LED assemblies are used. The LED subassemblies 920 may be located a few millimeters from the cross bars 917. As previously mentioned, if the mounting portion 915 of the TOD 910 is larger in the xy plane than the surface 931 of the base, then gaps or openings 916 may be present between the TOD 910 and the base 930 which can provide air flow between the ambient environment and the interior volume of the TOD 910.

FIG. 10 shows a plan view of a mounting portion 1015 of an exemplary TOD 1010 along with a cross section view taken along line N-N'. FIG. 10 illustrates a mounting portion 1015 that covers a majority of the base surface 1031, with bars 1017 that may extend beyond the base surface 1031. Openings 1016 are located between the edge of the base 1030 and the TOD mounting portion 1017. In this example, the TOD mounting portion 1015 also extends along the sides 1032 of the base 1030. In some examples, as illustrated by FIG. 10, a surface area of a mounting portion of the thermal optical diffuser that is in contact with the base may occupy at least 70%, at least 80%, or even at least 90% of the available surface area of the base surface. Note that the term "available space" refers to the surface area of the base that is accessible to mount TOD.

Figure 11:
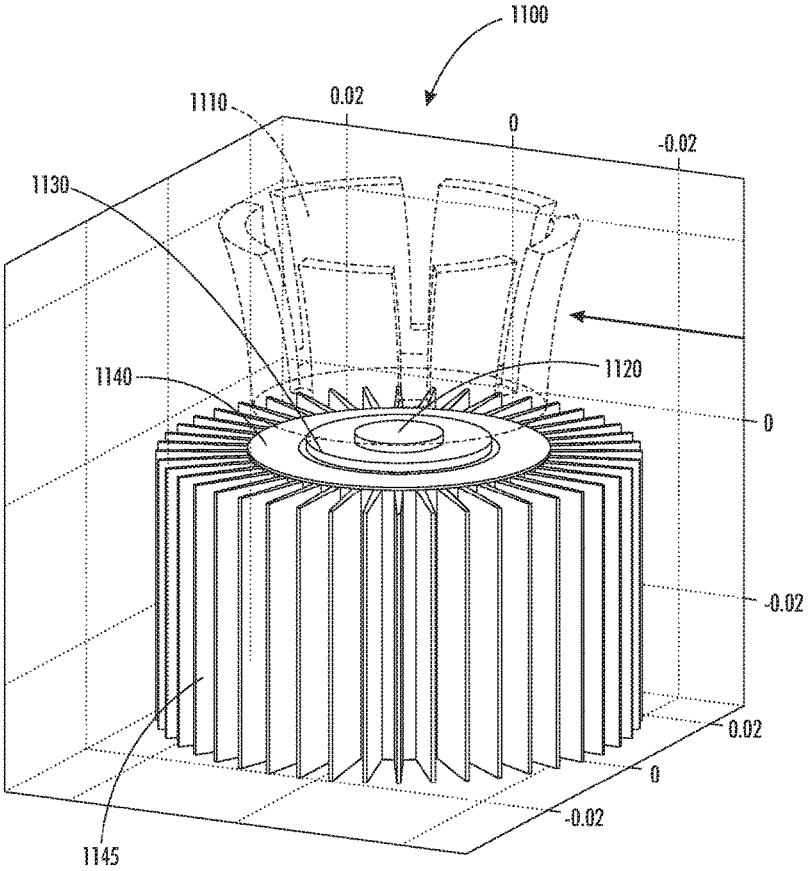
FIG. 11 depicts an LED bulb subassembly that includes a TOD and a case configured to contain the driver electronics for the LED(s)

In an LED light bulb, the one or more LEDs are electrically connected to driver electronics which operate to condition the input voltage to the LEDs, among other functions. The driver electronics generate heat, and the use of a second heat sink can be beneficial to dissipate heat generated by the driver electronics. FIG. 11 depicts an LED bulb subassembly 1100 that includes a case 1140 configured to contain the driver electronics (not visible in FIG. 11). The case 1140 has an integral heat sink or is coupled to a heat sink 1145. In the illustrated embodiment, the heat sink 1145 includes radially projecting fins. The LED assembly 1120 is disposed on a first surface of the base 1130 (along with the TOD 1110) and the opposing surface of the base 1130 is disposed on the case 1140 that contains the electronics. The case 1140 and its associated heat sink 1145 may or may not be thermally coupled to the base 1130. In thermally coupled implementations, the thermal resistance between the second heat sink 1145 and the base 1130 is less than 0.5° C./W.

Figure 12:
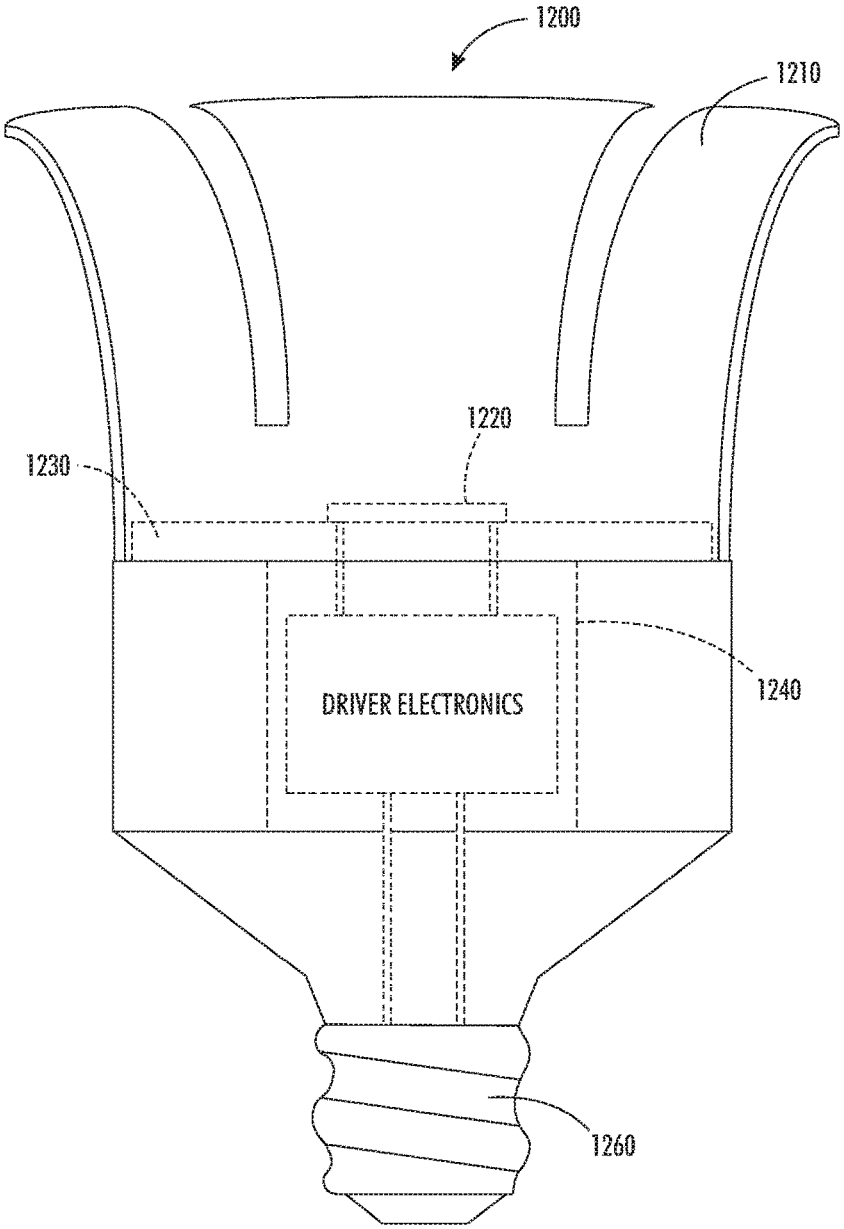
FIG. 12 shows the LED bulbs described herein disposed in a standard A-type incandescent light bulb form factor with an Edison base 1260.

The LED bulbs described herein are suitable replacements for standard incandescent light bulbs, such as the A-type incandescent light bulb with an Edison base 1260, as depicted in FIG. 12. FIG. 12 shows the LED light bulb 1200 including driver electronics disposed in a case 1240 and electrically coupled between the base 1260 and the LED assembly 1220. The LED assembly 1220 is disposed on a thermally conductive base 1230. A TOD 1210 is mounted on the same surface of the base 1230 as the LED assembly 1220 and is formed of one or more materials that provide both dissipation of heat generated by the LED and diffusion of light generated by the LED. The LED bulbs having TOD configurations described herein can achieve 75 We or 100 We in the incandescent form factor, making a significant positive impact on the solid state lighting market by opening the path for widespread adoption of retrofit LED bulbs at the true 75 We and 100 We replacement levels.

Figure 13:
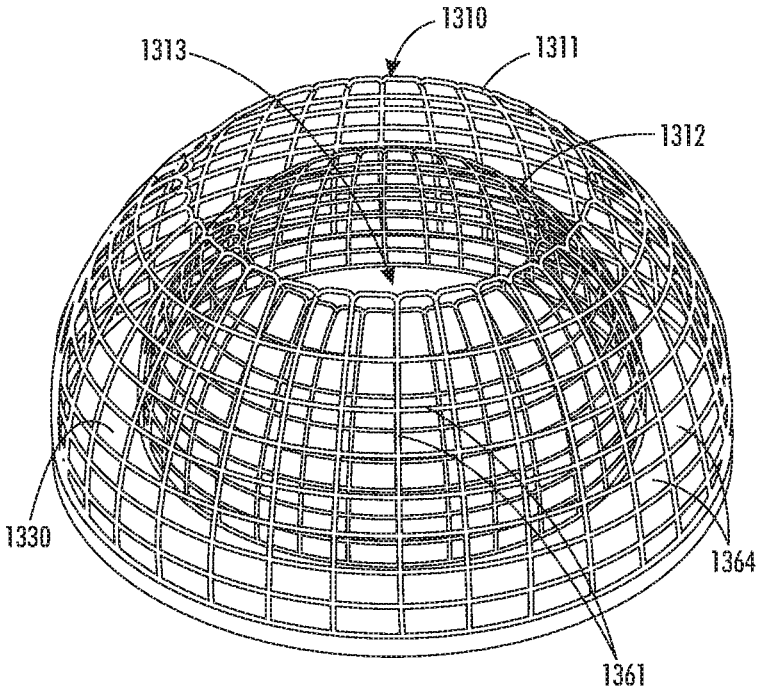
FIG. 13 depicts a TOD that includes two concentrically arranged hemispherical grids.

FIG. 13 shows another example of a TOD 1310 disposed on the surface of the base 1330. The LED assembly is not shown in FIG. 13, but would be disposed on the same surface as the TOD 1310. In the example of FIG. 13, the TOD 1310 includes two concentrically arranged hemispherical grids 1311, 1312, but it will be appreciated that structures other than hemispheres may be used or fewer or more structures may be used, or the structures may be arranged differently than the specific example shown in FIG. 13. The grids 1311, 1312 are formed by grid elements 1361 that are arranged to form the grids 1311, 1312 with interstices 1364 between the grid elements 1361. In the example of FIG. 13, the interstices 1364 are open and air from the external ambient environment can flow into the interior volume 1313 through these interstices 1364. The grids 1311, 1312 can be fabricated by stamping, casting, cutting, molding, machining, assembling piece parts (e.g., assembling and affixing grid elements in a grid pattern), 3-D printing, selective laser sintering (SLS), or any other suitable fabrication process. The grid can comprise any of the materials previously mentioned for that TOD, e.g., metal, metallic alloys, metal oxides, sintered metals, ceramic, glass, plastic, mica, diamond, polymers and/or other materials.

Figure 14:
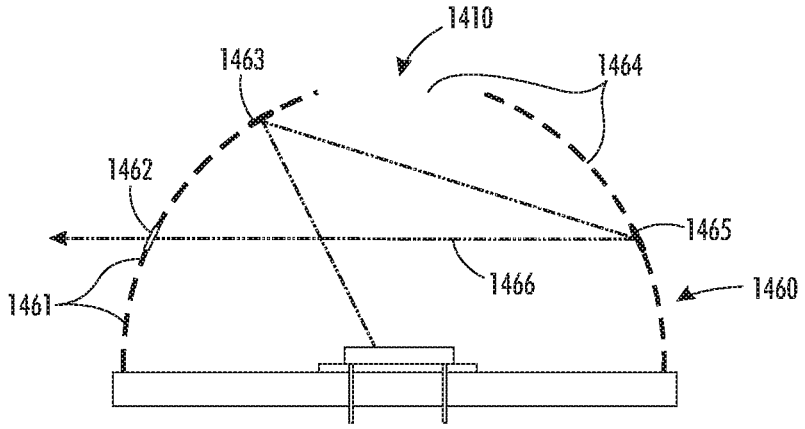
FIG. 14 shows a grid-based TOD that includes thermal grid elements and optical material disposed between the grid elements.

FIG. 14 shows another grid-based TOD 1410. In this example, the grid 1460 supports one or more types of materials 1462, 1463, 1465 that are disposed in some of the interstices 1464 of the grid 1460. Some of the interstices 1464 are open. The material of the grid elements 1461 that form the grid 1460 itself and/or materials 1462, 1463, 1465 in the interstices of the grid 1460 may comprise materials such as those mentioned in the preceding paragraph. These materials can be arranged to provide specified thermal and optical properties of the TOD 1410. The optical properties of the grid elements 1461 and/or materials 1462, 1463, 1465 in the interstices between the grid elements 1461 may comprise specular or diffusely reflective materials, optically transmissive materials, including transmissive diffusers, and/or opaque materials. In some embodiments, the material of the grid elements 1461 is a good thermal conductor and the grid primarily contributes the thermal conduction characteristics for the TOD 1410. In some embodiments, the materials 1462, 1463, 1465 disposed in the interstices between the grid elements 1461 are selected and arranged to achieve predetermined optical diffusion characteristics for the TOD 1410. The arrangement of the openings and interstices might be selected so as to provide a desired output profile and light field from the LED bulb, such as, task lighting with narrow focus, ambient lighting with broad symmetrical distribution of light all around the bulb, and spot lighting with desired light output cone angle and brightness. For example, the TOD may include structural elements, structural features, internal features, external features, open portions, optically opaque portions, optically reflective portions, and/or optically transmissive portions (in the visible spectrum) that are arranged to provide a predetermined cone angle of light, e.g., a cone angle of about 30 to 60 degrees.

The structural elements, internal features, external features, open portions, reflective portions, opaque portions, and/or transmissive portions (all in the visible spectrum) may be arranged in any way, such as a regular pattern or an irregular, random, pseudorandom, or fractal arrangement. The spatial arrangement of the elements, features, and/or portions of the TOD (e.g., regular, irregular, random, pseudorandom, and/or fractal) can be selected to achieve specified thermal and/or optical characteristics. For example, as a light diffuser, the TOD may be configured to achieve similar optical characteristics when compared with an incandescent light bulb of a watt equivalent capacity.

Figure 15A:
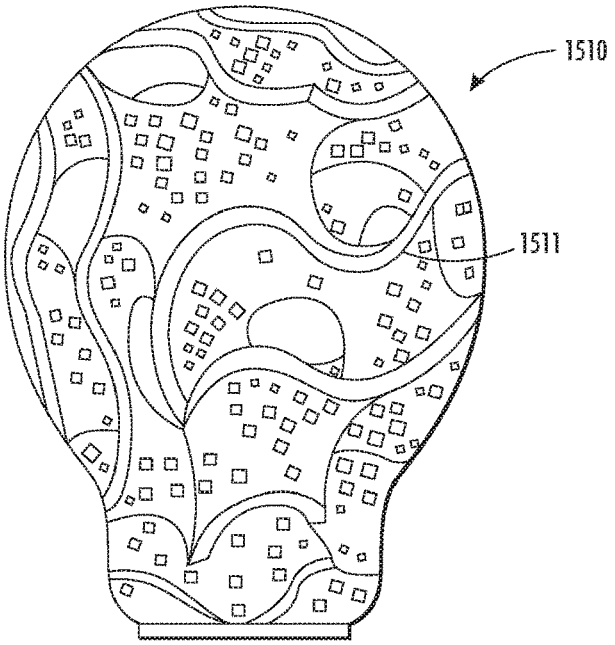
FIGS. 15A and 15B illustrate a TOD having irregular optical features.
Figure 15B:
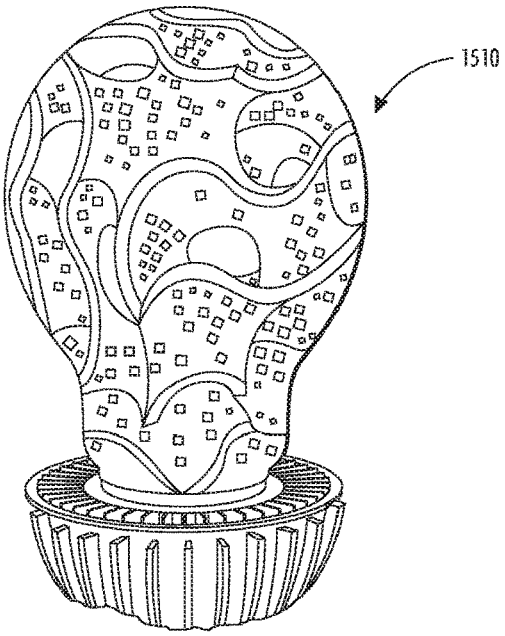
Figure 16A:
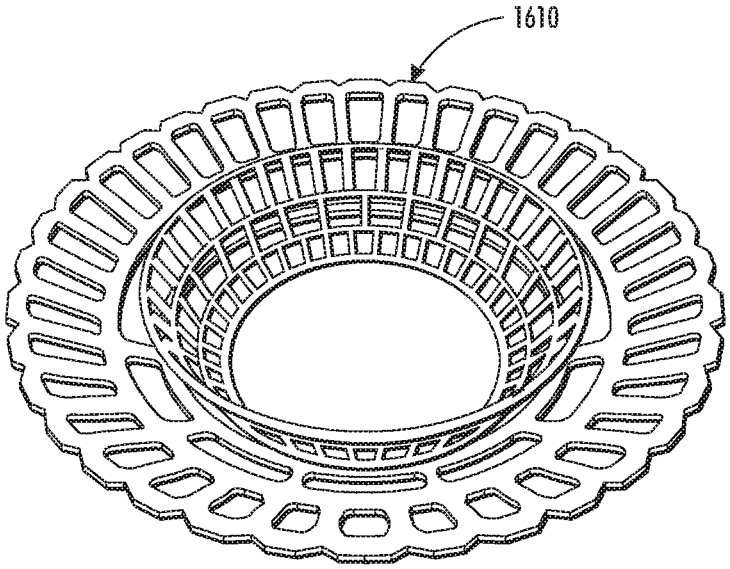
FIGS. 16A and 16B illustrate a grid-based TOD.
Figure 16B:
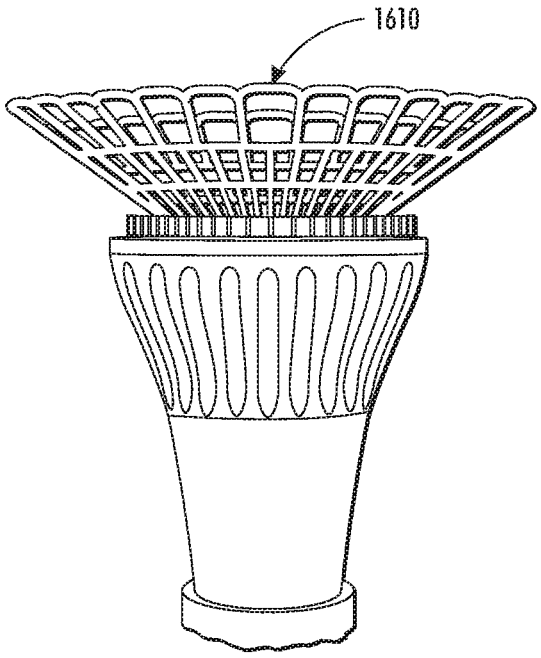

The TOD may have a spatially irregular configuration, meaning that there is no discernible pattern to the arrangement of at least some of the elements and/or components of the TOD. FIG. 15A illustrates a configuration of the TOD 1510 with a spatially irregular configuration. In this example, the structural element(s) of the TOD present a spatially irregular arrangement that includes an undulating edge 1511. FIG. 15B shows an LED light bulb that includes the TOD 1510 of FIG. 15A installed on the surface of a base along with an LED assembly. The spatially regular or irregular arrangement of the structural elements and/or optical features or TOD can serve to achieve specified optical and/or thermal characteristics. FIG. 16A shows another grid-based TOD 1610, which has a regular arrangement of grid elements and a more open grid design when compared to the TOD 1410 of FIG. 14. FIG. 16B shows an LED light bulb that includes the TOD 1610 of FIG. 16A disposed on the surface of a base along with an LED assembly.

Figure 17:
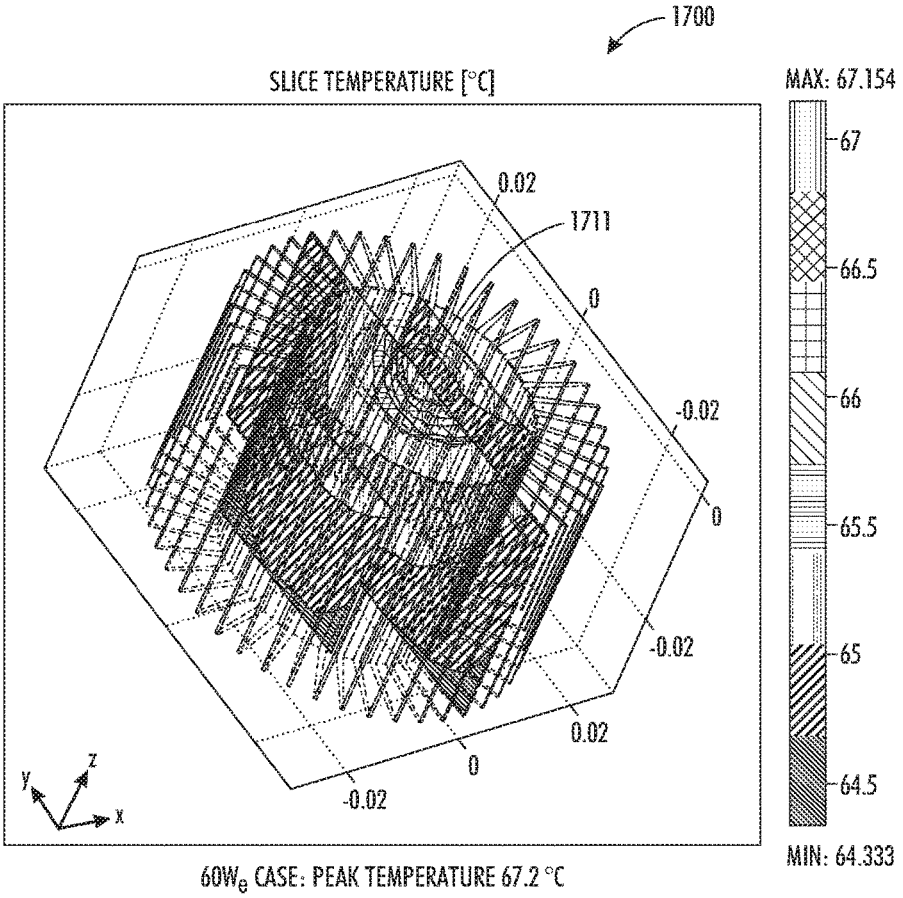
FIGS. 17 and 18 illustrate comparative simulations of 60 We LED bulb assemblies.
Figure 18:
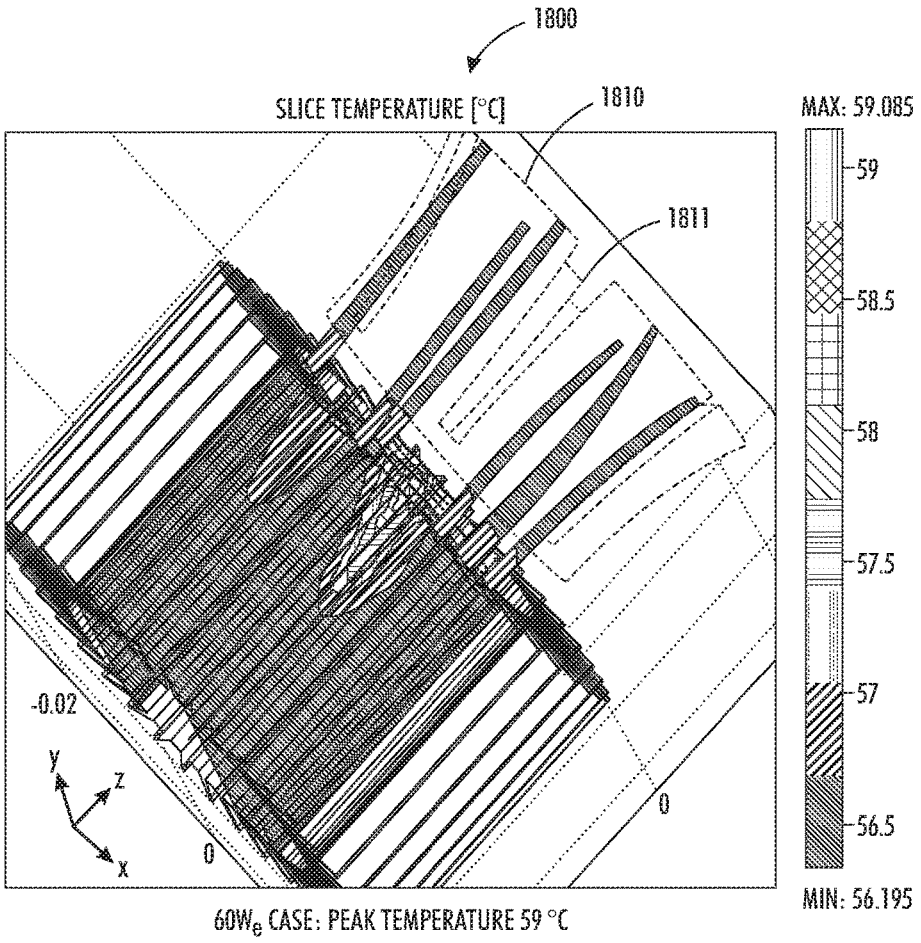

Thermal simulation results for a structure similar to the one shown in FIG. 11 are illustrated in FIGS. 17-18. In these simulations, the thermal performance of an LED bulb subassembly with a TOD is compared to the thermal performance of a similar LED bulb subassembly that does not include a TOD.

FIGS. 17 and 18 illustrate results of the comparative analysis for 60 We LED bulb assemblies 1700 and 1800, where the subassembly 1800 includes driver electronics, case, case heat sink, base, LED assembly and TOD 1810, and subassembly 1700 includes driver electronics, case, case heat sink, base, and LED assembly without the TOD. In this comparative simulation, the LED bulb subassembly 1800 with the TOD 1610 significantly thermally outperforms the similar structure 1700 without the TOD. The subassembly 1800 has a peak 1811 temperature that is 8.2° C. cooler than the peak temperature 1711 of subassembly 1700.

Figure 19:
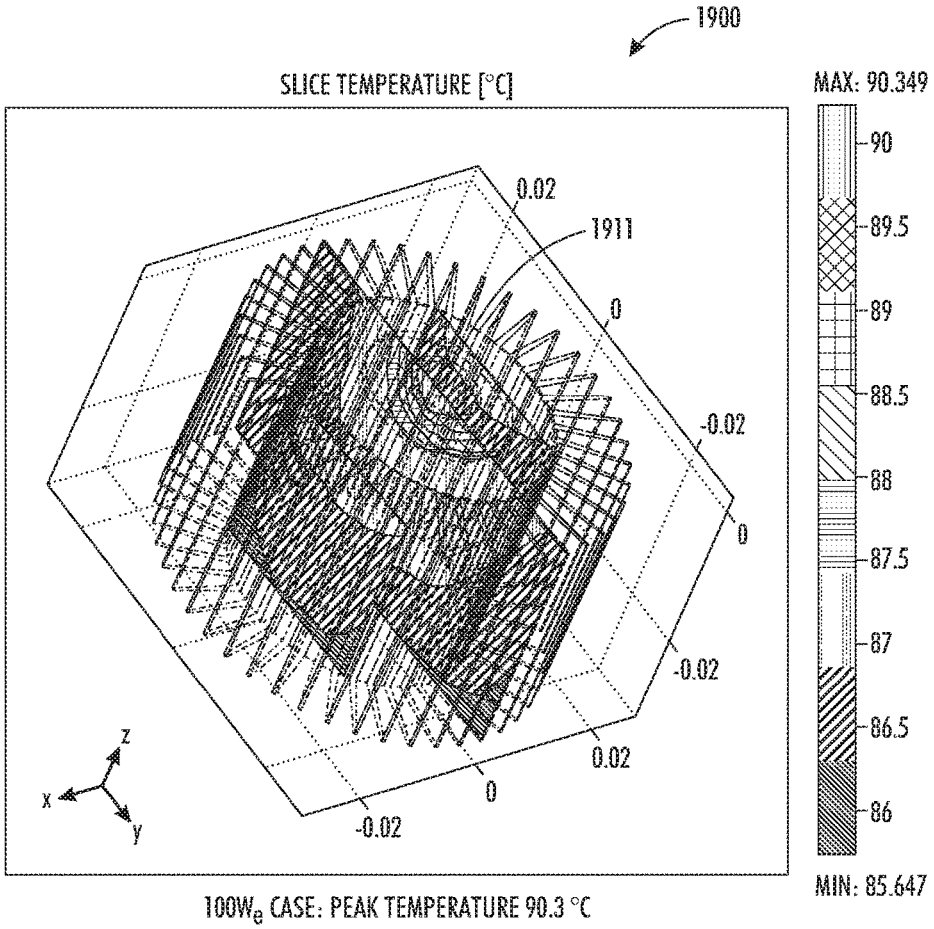
FIGS. 19 and 20 illustrate comparative simulations of 100 We LED bulb assemblies.
Figure 20:
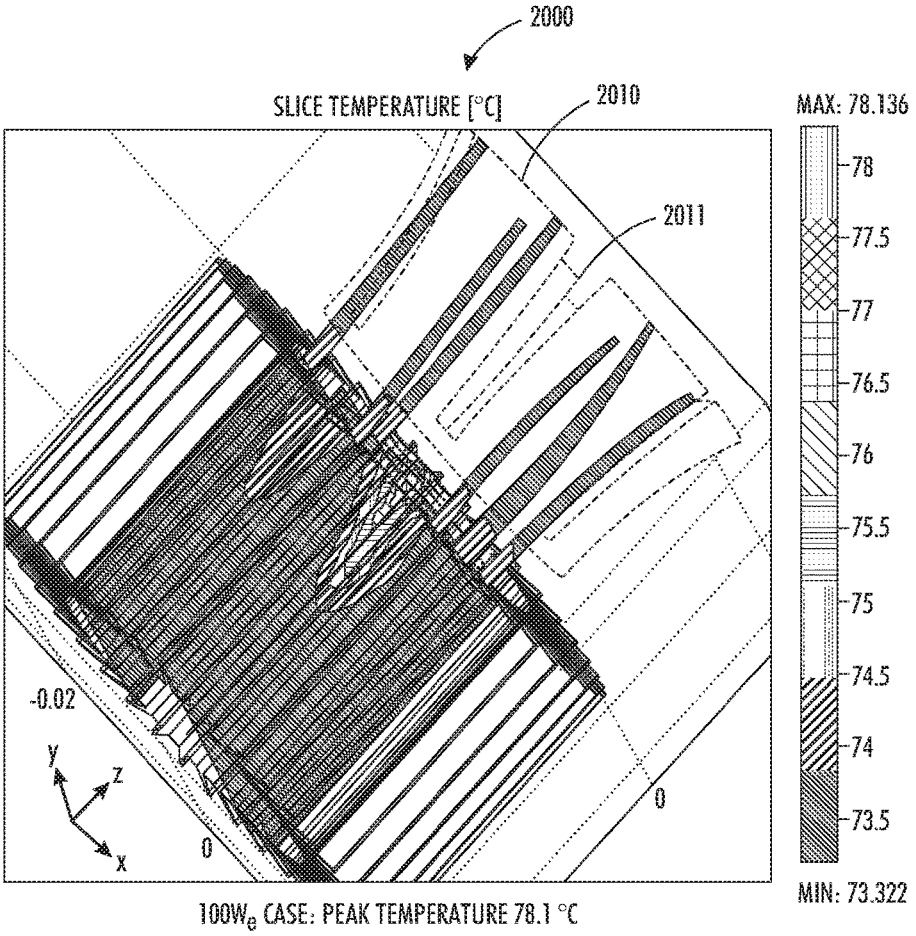

Comparative thermal simulation results for 100 We LED bulb subassemblies are shown in FIGS. 19 and 20. FIG. 19 shows the LED bulb subassembly 1900 including driver electronics, case, case heat sink, base, LED assembly without the TOD. FIG. 20 shows a LED bulb subassembly 2000 that includes driver electronics, case, case heat sink, base, LED assembly and the TOD 2010. In the comparative simulation, the subassembly 1800 that includes the TOD 2010 significantly thermally outperforms the similar structure 1900 without the TOD. The subassembly 2000 that includes the TOD 2010 has a peak 2011 temperature that is 12.2° C. cooler than the peak temperature 1911 of the TOD-less subassembly 1900.

The simulations of the TOD designs indicate a significant advance in thermal and optical management for LED light bulbs. Due to the exponential nature of the relationship between device failure rates and operating temperature for components such as electrolytic capacitors in the driver electronics and also the LED chip itself, even a 10° C. reduction in temperatures has the potential to double the average system lifetime.

Approaches discussed above involve an integrated TOD for an LED light bulb, wherein the integrated diffuser is located in proximity to the light emission side of the light bulb. The material of the TOD may include at least one material selected from the group consisting of: a metal, a metal alloy, a sintered metal, a high thermal conductivity ceramic, a polymer, diamond, and mica. The surface material of the TOD may have a reflectivity of at least 70% in the visible range of wavelengths of light. Structural geometry of the TOD is selected such that it provides a surface area in contact with ambient air of at least 4 square centimeters for every cubic centimeter of volume of the diffuser. The structural geometry enhances total light output of the LED light bulb, enabling overall bulb dimensions similar to an incandescent bulb of equivalent luminosity while simultaneously providing substantial heat removal from the light emitting side of the LED bulb through natural convection and enhanced surface area of the TOD in contact with the air.

Systems, devices, or methods disclosed herein may include one or more of the features, structures, methods, or combinations thereof described herein. For example, a device or method may be implemented to include one or more of the features and/or processes described herein. It is intended that such device or method need not include all of the features and/or processes described herein, but may be implemented to include selected features and/or processes that provide useful structures and/or functionality.

In the detailed description, numeric values and ranges are provided for various aspects of the implementations described. These values and ranges are to be treated as examples only, and are not intended to limit the scope of the claims. For example, embodiments described in this disclosure can be practiced throughout the disclosed numerical ranges. In addition, a number of materials are identified as suitable for various facets of the implementations. These materials are to be treated as exemplary, and are not intended to limit the scope of the claims.

The foregoing description of various embodiments has been presented for the purposes of illustration and description and not limitation. The embodiments disclosed are not intended to be exhaustive or to limit the possible implementations to the embodiments disclosed. Many modifications and variations are possible in light of the above teaching.

The invention claimed is:

1. A light emitting diode (LED) light bulb comprising:

a base;

at least one LED assembly disposed on and thermally coupled to a surface of the base, the at least one LED assembly comprising at least one LED configured to generate light; and a thermal optical diffuser that defines an interior volume, the at least one LED arranged to emit light into the interior volume and through the thermal optical diffuser, the thermal optical diffuser having a first end located at a first distance from the base and an opposing second end located at a second distance from the base, the second distance being larger than the first distance, the thermal optical diffuser further comprising:

one or more openings arranged to allow convective air flow between the interior volume of the thermal optical diffuser and an ambient environment exterior to the bulb;

at least one thermally conductive portion comprising a thermally conductive material; and at least one optically transmissive portion comprising an optically transmissive material, the optically transmissive portion positioned between the first end and the second end of the thermal optical diffuser.

2. The LED light bulb of claim 1, wherein the one or more openings include at least one opening located proximate to the first end of the thermal optical diffuser and at least another opening located proximate to the second end of the thermal optical diffuser.

3. The LED light bulb of claim 2, wherein the one or more openings located proximate to the first end are openings in the optically transmissive portion.

4. The LED light bulb of claim 2, wherein the one or more openings located proximate to the second end are openings in the optically transmissive portion.

5. The LED light bulb of claim 1, wherein the optically transmissive material has greater than 50% optical transmittance.

6. The LED light bulb of claim 1, wherein the optically transmissive material has greater than 75% optical transmittance.

7. The LED light bulb of claim 1, wherein the optically transmissive material is a polymer.

8. The LED light bulb of claim 1, wherein the optically transmissive material is a plastic.

9. The LED light bulb of claim 1, wherein the thermally conductive material is a metal.

10. The LED light bulb of claim 1, wherein the thermally conductive portion comprises copper.

11. The LED light bulb of claim 1, wherein the thermally conductive portion comprises aluminum.

12. The LED light bulb of claim 1, wherein the thermally conductive portion comprises at least one layer that contributes to the thermal diffusion capabilities of the thermal optical diffuser.

13. The LED light bulb of claim 12, wherein the at least one layer comprises at least one metal layer.

14. The LED light bulb of claim 1, wherein the base comprises the thermally conductive material.

15. The LED light bulb of claim 1, wherein at least some of the thermally conductive portion is coated with a light reflecting coating.

16. The LED light bulb of claim 15, wherein the light reflecting coating reflects light of wavelengths in the range of 390 nm to 750 nm.

17. The LED light bulb of claim 1, wherein the convective air flow occurs over a light emitting side of the LED.

18. The LED light bulb of claim 1, further comprising geometrical structures arranged such that the convective air flow occurs over a light emitting side of the LED.

19. The LED light bulb of claim 1, wherein the one or more openings are arranged such that a first opening of the one or more openings is located at a distance of less than about 10 mm from the base.

20. The LED light bulb of claim 1, wherein the LED light bulb has geometrical shape and proportions that allow it to be arranged within incandescent bulb form factors type A, B, BR/R, BT, G, MR, PAR, R/K, or T.

21. The LED light bulb of claim 1, wherein the LED bulb is configured as a replacement for an incandescent bulb with a standard threaded Edison base.

22. The LED light bulb of claim 1, wherein the base and the thermal optical diffuser is a one-piece unit.

23. The LED light bulb of claim 1, wherein the thermal optical diffuser comprises at least one molded component.

24. A light emitting diode (LED) light bulb comprising:

a base;

a thermal optical diffuser that defines an interior volume, the thermal optical diffuser having a first end located at a first distance from the base and an opposing second end located at a second distance from the base, the second distance being larger than the first distance, the thermal optical diffuser further comprising:

one or more openings arranged to allow convective air flow between the interior volume of the thermal optical diffuser and an ambient environment exterior to the bulb;

at least one thermally conductive portion comprising a thermally conductive material; and at least one optically transmissive portion comprising an optically transmissive material, the optically transmissive portion extending from the first end of the thermal optical diffuser to the second end of the thermal optical diffuser; and at least one LED assembly comprising at least one LED configured to generate light and arranged to emit the light into the interior volume and through the thermal optical diffuser.

* * * * *